US006041606A

United States Patent [19]

Kim

[11] Patent Number: 6,041,606

[45] Date of Patent: Mar. 28, 2000

[54] COOL AIR SUPPLYING DEVICE FOR FRESH FOOD COMPARTMENT IN REFRIGERATORS

[75] Inventor: Seok Ro Kim, Changwon, Rep. of Korea

[73] Assignee: LG Electronics, Inc., Seoul, Rep. of Korea

[21] Appl. No.: 09/141,583

[22] Filed: Aug. 28, 1998

[30] Foreign Application Priority Data

Aug. 28, 1997 [KR] Rep. of Korea ..... 97-42052

[51] Int. Cl.[7] ..... F25D 17/04

[52] U.S. Cl. ..... 62/186; 62/408; 62/441

[58] Field of Search ..... 62/186, 187, 408, 62/426, 441

[56] References Cited

U.S. PATENT DOCUMENTS 5,319,937 6/1994 Fritsch et al. ..... 62/426 X 5,826,437 10/1998 Kim ..... 62/186

*Primary Examiner*—Henry Bennett

*Assistant Examiner*—Susane C. Tinker

[57] ABSTRACT

A cool air supplying device for a fresh food compartment in refrigerators is disclosed. In the device, a cool air passage extends from an evaporator to the fresh food compartment. A connection duct is branched from the passage and extends to a front portion of the fresh food compartment. A plurality of door ducts are provided on the door of the fresh food compartment and individually have an air inlet opening at a position selectively aligned with an associated one of the air outlet openings of the connection duct. The door ducts also have a plurality of air outlet ports capable of discharging cool air from the door ducts into the fresh food compartment rearwardly. The amount of cool air for the air outlet openings of the connection duct is controlled by a cool air distribution unit. The air distribution unit has a motored regulator.

9 Claims, 4 Drawing Sheets

FIG, 6
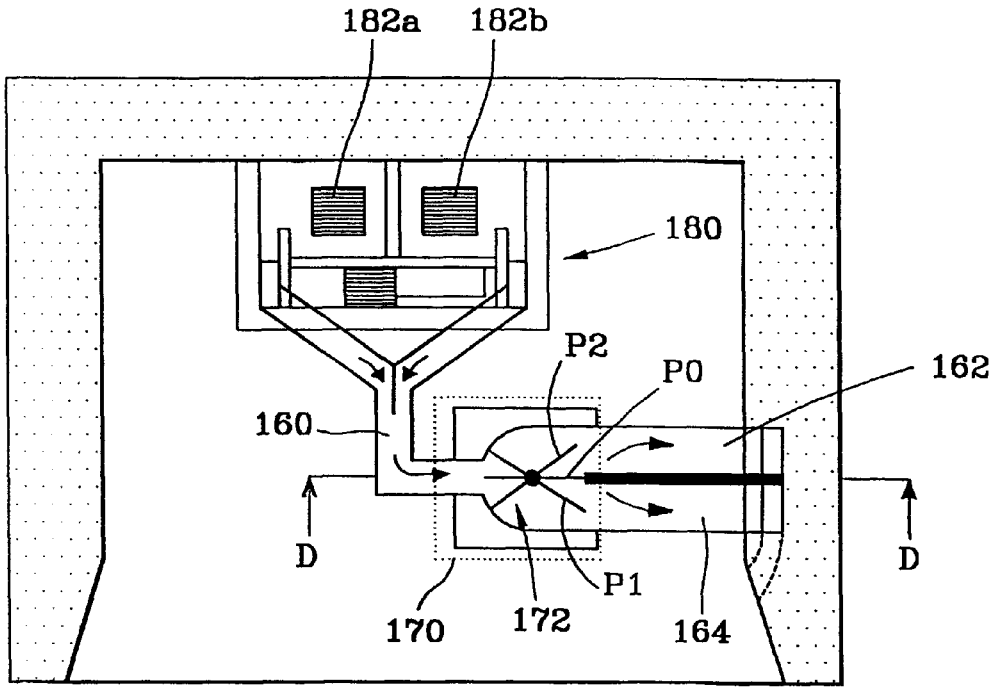
FIG. 7
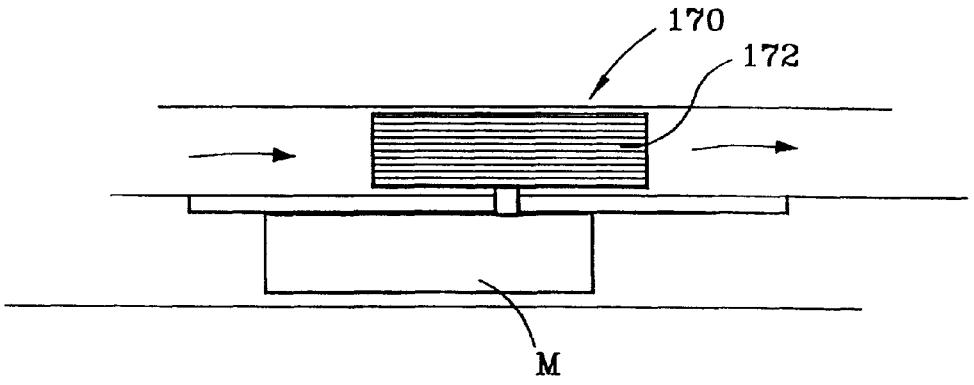

COOL AIR SUPPLYING DEVICE FOR FRESH FOOD COMPARTMENT IN REFRIGERATORS

BACKGROUND OF THE INVENTION

1. Field of the Invention

The present invention relates, in general, to a cool air supplying device for a fresh food compartment in refrigerators and, more particularly, to a cool air supplying device capable of uniformly supplying cool air into the whole area inside a fresh food compartment and concentrically supplying cool air to an area around the door of the fresh food compartment, thus effectively cooling food newly stored in such an area.

2. Description of the Prior Art

In typical refrigerators with freezer and fresh food compartments, the refrigeration cycle is designed for starting to supply cool air into at least one of the two compartments when the sensed temperature of the compartment (freezer or fresh food compartment) is higher than a reference point. For example, when the temperature, sensed by a temperature sensor installed in the fresh food compartment, is higher than a reference point, for example, 3° C., cool air is supplied into the fresh food compartment to cool the compartment. On the contrary, when the sensed temperature of the fresh food compartment is lower than the reference point, the supplying of new cool air for the fresh food compartment is stopped.

FIG. 1 is a front view showing the interior of a typical refrigerator with the doors of two compartments being opened. FIG. 2 is a sectional view taken along the line A—A of FIG. 1, showing a cool air circulation inside the refrigerator.

As shown in the drawings, the interior of the typical refrigerator is divided into two compartments: freezer and fresh food compartments 10 and 20, by a barrier 15. The cool air supplying device for the above refrigerator is constructed as follows. That is, an evaporator 13 is provided in the heat exchanging chamber 12 formed behind the freezer compartment 10. Cool air from the evaporator 13 orderly flows to a shroud 16 and a grille fan 17, which are positioned in front of the chamber 10, by the suction force of a blower fan 14.

Some of cool air from the shroud 16 and the fan 17 is supplied into the freezer compartment 10. A remaining part of the cool air passes through a damper (not shown) prior to reaching a rear duct 22 which is arrayed on the rear wall of the fresh food compartment 20. The above damper is for controlling the amount of cool air for the fresh food compartment 20. The cool air is, thereafter, discharged from the duct 22 into the compartment 20 through a plurality of air outlet ports 22*a*, 22*b* and 22*c* of the duct 22.

A plurality of temperature sensors Sa and Sb are installed on the side and/or rear wall of the fresh food compartment 20 to sense the temperatures of said compartment 20 at different positions. The cool air supply for the fresh food compartment 20 is controlled in response to the temperatures of said compartment 20 sensed by the sensors Sa and Sb.

A plurality of door baskets 24*a*, 24*b* and 24*c*, used for storing food, are installed on the inside wall of the door 24 of the fresh food compartment 20.

However, the above cool air supplying device has the following problems. That is, since the door baskets 24*a*, 24*b* and 24*c* are spaced apart from the rear duct 22 at quite a distance, cool air from the duct 22 cannot effectively reach the door baskets 24*a*, 24*b* and 24*c*. In addition, the sensors Sa and Sb of the fresh food compartment 20 are installed on the side and/or rear wall of the fresh food compartment 20 as described above, so that the sensors Sa and Sb fail to exactly sense the temperatures around the door baskets 24*a*, 24*b* and 24*c*. Therefore, the above cool air supplying device may fail to supply cool air into the fresh food compartment 20 even when at least one of the temperatures around the door baskets 24*a*, 24*b* and 24*c* is higher than a reference point.

The typical cool air supplying device is thus problematic in that food, positioned around the rear duct 22, may be exceedingly cooled, while food, positioned around the door 24 of the fresh food compartment 20, may be not effectively cooled. That is, the above cool air supplying device fails to uniformly supply cool air to the whole area in the fresh food compartment.

Particularly, when the door 24 of the fresh food compartment 20 is repeatedly opened and closed, the door baskets 24*a*, 24*b* and 24*c* on the inside wall of the door 24 are exposed to hot atmospheric air. This causes the temperature around the baskets 24*a*, 24*b* and 24*c* to rise. It is thus difficult for such a cool air supplying device to maintain the freshness of food and drink in the baskets 24*a*, 24*b* and 24*c* for a lengthy period of time. In addition, when the door 24 is repeatedly opened and closed, hot atmospheric air is introduced into the fresh food compartment 20, so that the above refrigerator fails to maintain the freshness of food and drink, stored on the shelves 26 in the fresh food compartment 20 at a position around the door 24, for a lengthy period of time.

When food is newly stored in a specific area of the above door baskets 24*a*, 24*b* and 24*c*, the temperature around the area with the newly stored food rises higher than the other areas of the baskets 24*a*, 24*b* and 24*c*. However, the typical cooling air supply device is not designed for concentrically supplying cool air to the specific area with newly loaded food, so that it fails to effectively and quickly reduce the temperature around said area.

SUMMARY OF THE INVENTION

Accordingly, the present invention has been made keeping in mind the above problems occurring in the prior art, and an object of the present invention is to provide a cool air supplying device, which is capable of uniformly supplying cool air into the whole area inside a fresh food compartment of a refrigerator.

Another object of the present invention is to provide a cool air supplying device, which is capable of concentrically supplying cool air to one of the door baskets newly loaded with food, thus effectively cooling food newly stored on the basket.

In order to accomplish the above object, the present invention provides a cool air supplying device for a fresh food compartment in refrigerators, comprising: a cool air passage extending from an evaporator to the fresh food compartment; a connection duct branched from the passage and extending to a front portion of the compartment with a plurality of air outlet openings of the connection duct being positioned at the front portion of the compartment; a plurality of door ducts provided on a door of the fresh food compartment and individually having an air inlet opening at a position selectively aligned with an associated one of the air outlet openings of the connection duct when the door is fully closed, the door ducts also individually having a plurality of air outlet ports capable of discharging cool air from each of the door ducts into the fresh food compartment in a direction from the door to a rear wall of the compartment; and a cool air distribution unit controlling the amount of cool air for the outlet openings of the connection duct.

In accordance with the above device, it is possible to discharge cool air from the door ducts into the fresh food compartment rearwardly, thus uniformly cooling all areas of the fresh food compartment. It is also possible to concentrically discharge cool air from the door ducts to a specific area inside the fresh food compartment by the cool air distribution unit.

In the preferred embodiment, the number of air outlet openings of the connection duct and the number of the door ducts are individually two. In addition, the cool air distribution unit comprises a rotatable regulator provided at a branched junction where the two air outlet openings are branched from the connection duct, and a means for selectively rotating the regulator between a plurality of angular positions, thus allowing the regulator to control the amount of cool air for the two door ducts.

BRIEF DESCRIPTION OF THE DRAWINGS

The above and other objects, features and other advantages of the present invention will be more clearly understood from the following detailed description taken in conjunction with the accompanying drawings, in which:

FIG. 6 is a sectional view taken along the line C—C of FIG. 3; and

FIG. 7 is a sectional view taken along the line D—D of FIG. 3.

DESCRIPTION OF THE PREFERRED EMBODIMENTS

Figure 1:
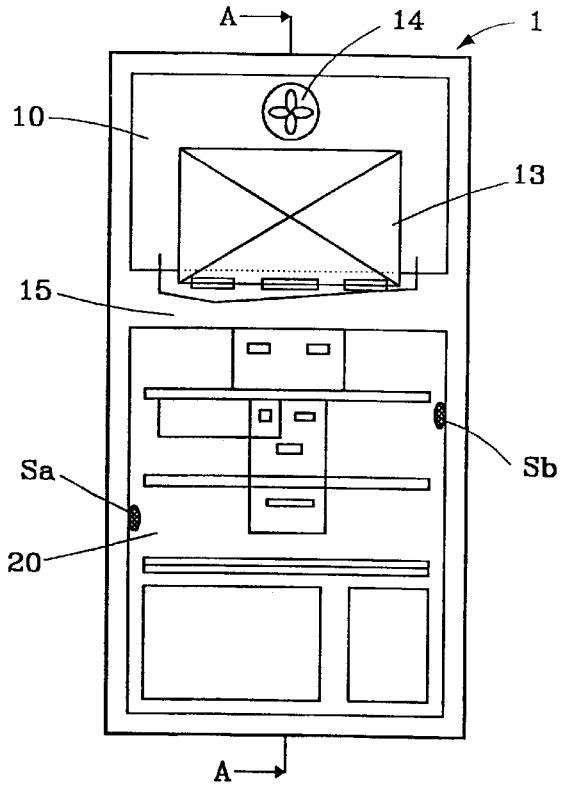
FIG. 1 is a front view showing the interior of a typical refrigerator with the doors of two compartments being opened.
Figure 2:
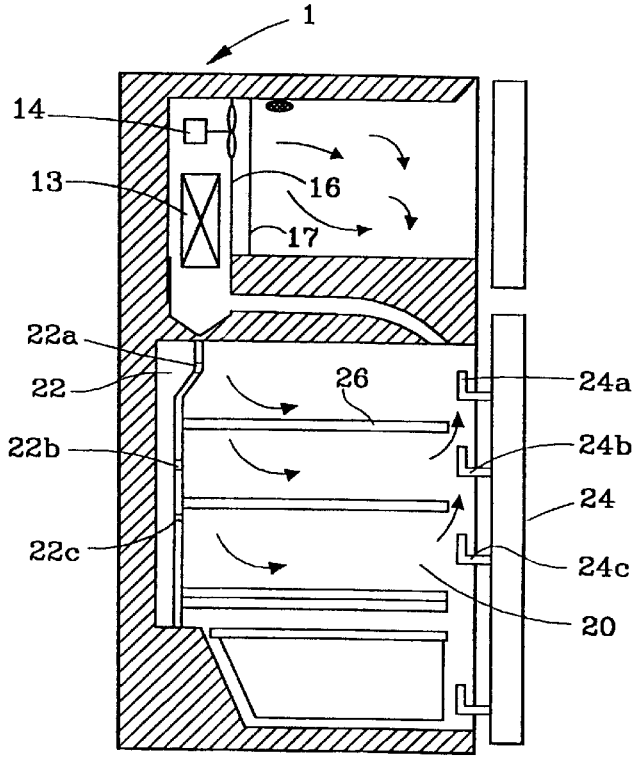
FIG. 2 is a sectional view taken along the line A—A of FIG. 1, showing a cool air circulation inside the refrigerator.
Figure 3:
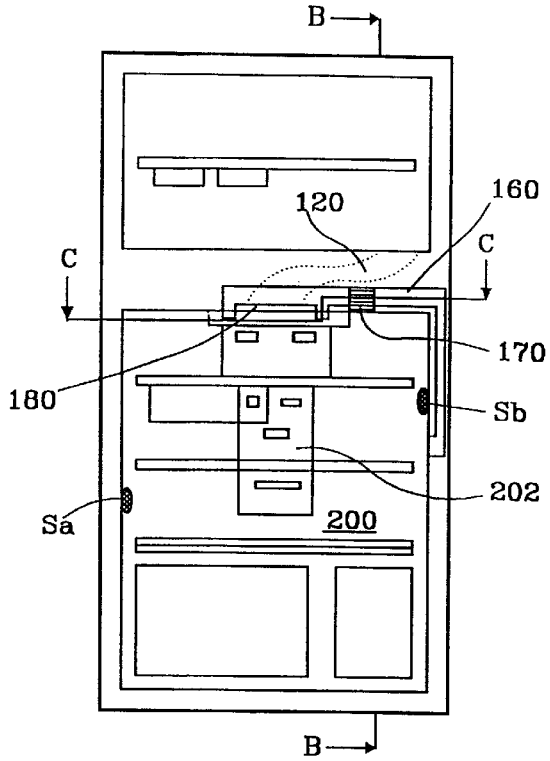
FIG. 3 is a front view showing the interior of a refrigerator according to the preferred embodiment of the present invention with the doors of two compartments being opened.
Figure 4:
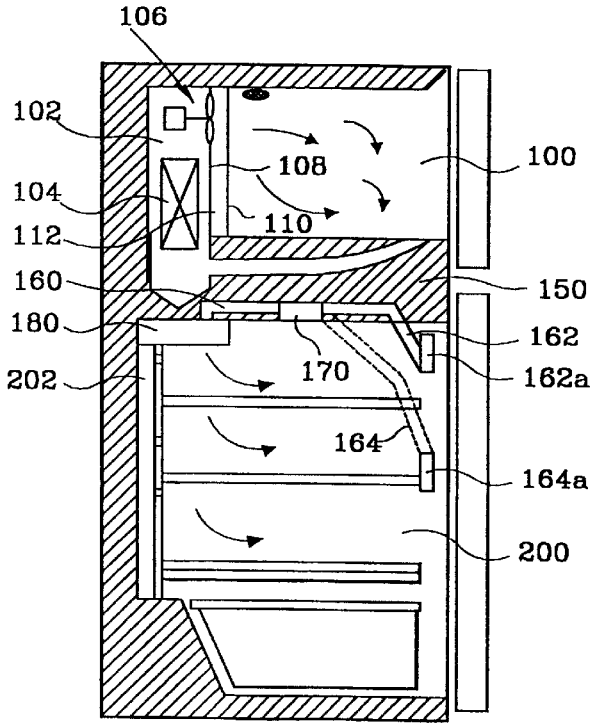
FIG. 4 is a sectional view taken along the line B—B of FIG. 3, showing a cool air circulation inside the refrigerator.

FIG. 3 is a front view showing the interior of a refrigerator according to the preferred embodiment of this invention with the doors of two compartments being opened. FIG. 4 is a sectional view taken along the line B—B of FIG. 3, showing a cool air circulation inside the refrigerator.

As shown in the drawings, the interior of the refrigerator is divided into two compartments: freezer and fresh food compartments 100 and 200, by a barrier 150. The cool air supplying device for the above refrigerator is constructed as follows. That is, an evaporator 104 is provided in the heat exchanging chamber 102 formed behind the freezer compartment 100. Cool air from the evaporator 104 orderly flows to both compartments 100 and 200 by the suction force of a blower fan 106.

Some of cool air from the chamber 102 orderly passes through a shroud 108 and a grille fan 110 prior to being introduced into the freezer compartment 100. A remaining part of the cool air from the chamber 102 passes through a first passage 112, which is defined between the shroud 108 and the grille fan 110. The cool air is, thereafter, introduced into a rear duct 202 through a second passage 120 which communicates with the first passage 112. The above rear duct 202 is arrayed on the rear wall of the fresh food compartment 200.

As shown in FIG. 3, a connection duct 160 is branched from the second passage 120 extending to the rear duct 202 of the fresh food compartment 200.

In the preferred embodiment, the connection duct 160 is branched from a damper device 180, which is provided on the second passage 120 for controlling the amount of cool air for the fresh food compartment 200. In this embodiment, a twin damper, having two baffles 182*a* and 182*b*, is used as the damper device 180 as shown in FIG. 6. In the damper device 180, the two baffles 182*a* and 182*b* respectively control the amount of cool air for the rear duct 202 and a fresh chamber (not shown), both being provided in the fresh food compartment 200, as an example. Of course, it is possible to use a known damper as the damper device 180. The above twin damper is also well known to those skilled in the art and further explanation is thus not deemed necessary.

As shown in FIG. 6, the connection duct 160 is branched from the damper device 180. Cool air is thus introduced into the connection duct 160 when cool air is supplied to the fresh food compartment 200 through the damper device 180.

Figure 5:
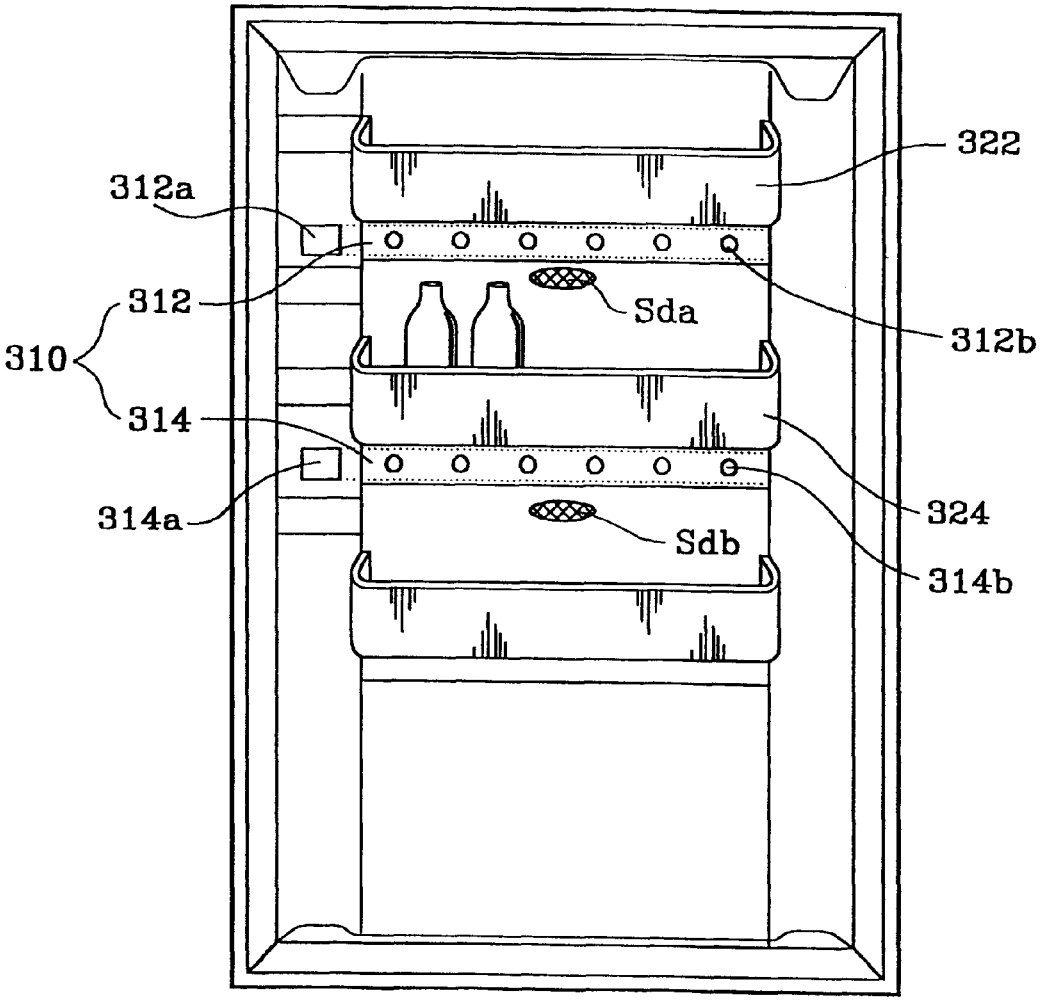
FIG. 5 is a front view of the fresh food compartment door of the refrigerator according to this invention, showing the construction of door baskets provided on the inside wall of the door.

The above connection duct 160 is for guiding cool air from the passage 120 to a door duct 310 provided on the door 300 of the fresh food compartment 200. The construction of the above door 300 is shown in FIG. 5. The above connection duct 160 is branched into two ducts: first and second branch ducts 162 and 164. Each of the first and second branch ducts 162 and 164 is provided with an outlet opening 162*a*, 164*a* at a position around the front portion of the fresh food compartment 200.

A cool air distribution unit 170 is provided at the branched junction where the two branch ducts 162 and 164 are branched from the connection duct 160. The above distribution unit 170 is for controlling the flowing direction of cool air from the connection duct 160, thus guiding the cool air into either one of the two branch ducts 162 and 164. That is, the unit 170 selectively controls the amount of cool air for the two branch ducts 162 and 164.

As shown in FIGS. 6 and 7, the cool air distribution unit 170 comprises a drive motor M and a rotatable regulator 172. The above regulator 172 is operated by the motor M to rotate so that the angular position of the regulator 172 is variable. Since the regulator 172 is rotated by the motor M, the regulator 172 controls the amount of cool air for the two branch ducts 162 and 164 in accordance with its angular position. The operation of the cool air distribution unit 170 will be described with reference to FIG. 6. When the regulator 172 is rotated to a position P0 by the motor M, cool air from the connection duct 160 is guided into both branch ducts 162 and 164. When the regulator 172 is rotated to another position P1 by the motor M, cool air from the connection duct 160 is exclusively guided into the second branch duct 164. Meanwhile, when the regulator 172 is rotated to another position P2 by the motor M, cool air from the connection duct 160 is exclusively guided into the first branch duct 162.

In the above embodiment, the connection duct 160, with the two branch ducts 162 and 164, are provided in the barrier 150 and in the side wall of the fresh food compartment 200. Since both the connection duct 160 and the two branch ducts 162 and 164 are all set in the insulating material of both the barrier 150 and the side wall of the fresh food compartment 200, the above ducts 160, 162 and 164 are free from being dewed or frozen due to a temperature difference between the ducts 160, 162 and 164 and the interior of the fresh food compartment 200. However, it should be understood that the ducts 160, 162 and 164 may be arranged on the interior surface of the side wall of the fresh food compartment 200 prior to reaching the front portion of said compartment 200. In such a case, it is preferable to cover the ducts 160, 162 and 164 with an additional insulating cover to thermally insulate the ducts 160, 162 and 164 from the compartment 200.

The above motor M, used for rotating the regulator 172 between the three positions P0, P1 and P2, is controlled in response to temperatures sensed by temperature sensors Sda and Sdb provided on the door 300.

The construction of the door duct 310 is shown in FIG. 5. As shown in the drawing, the door duct 310 comprises two ducts: first and second door ducts 312 and 314. The above first and second door ducts 312 and 314, respectively and horizontally attached to the interior wall of the door 300 at upper and lower positions, separately receive cool air from the connection duct 160 prior to discharging the cool air in a direction from the door to the rear wall of the fresh food compartment 200. In such a case, the first door duct 312 receives cool air from the first branch duct 162, while the second door duct 314 receives cool air from the second branch duct 164.

The inlet opening 312*a* of the first door duct 312 is positioned in a way such that the opening 312*a* is aligned and communicates with the outlet opening 162*a* of the first branch duct 162 when the door 300 is fully closed. In the same manner, the inlet opening 314*a* of the second door duct 314 is positioned in a way such that the opening 314*a* is aligned and communicates with the outlet opening 164*a* of the second branch duct 164 when the door 300 is fully closed.

In the operation of the refrigerator, cool air is discharged from the two door ducts 312 and 314 into the interior of the fresh food compartment 200 through a plurality of air outlet ports 312*b* and 314*b* of the ducts 312 and 314. That is, the cool air is discharged from the outlet ports 312*b* and 314*b* into the fresh food compartment 200 in a direction from the door 300 to the rear wall of said compartment 200. Since the cool air supplying device of this invention discharges cool air rearwardly from the door ducts 312 and 314 and forwardly from the rear duct 202, the fresh food compartment 200 is uniformly cooled and this eliminates any temperature difference between areas in said compartment 200. It is thus possible to maintain the freshness of food in the fresh food compartment 200 for a lengthy period of time regardless of areas loaded with food.

In the preferred embodiment, the two door ducts 312 and 314 are provided on the interior wall of the door 300 at positions under the door baskets 322 and 324 in parallel to said baskets 322 and 324, respectively. Of course, it should be understood that the position of the two door ducts 312 and 314 may be freely changed if the ducts 312 and 314 effectively discharge cool air into the fresh food compartment 200 in a rearward direction.

For example, the two door ducts 312 and 314 may be positioned inside the door baskets 322 and 324, respectively. In such a case, since the door ducts 312 and 314 are not outwardly visible, the interior wall of the door 300 has a simple design and this improves the appearance of the door 300. Alternatively, each of the two door ducts 312 and 314 may be cast with an associated door basket 322, 324 into a single structure.

In the present invention, the air outlet ports 312*b* and 314*b* of the door ducts 312 and 314 may be designed for being all opened toward the rear wall of the fresh food compartment 200. Alternatively, the above ports 312*b* and 314*b* may be designed for being all opened toward the interior of the door baskets 322 and 324. As a further alternative, the ports 312*b* and 314*b* may be designed so that some them are opened toward the rear wall of the fresh food compartment 200 and the remaining part of them may be opened toward the interior of the door baskets 322 and 324.

The interior wall of the door 300 is provided with a plurality of temperature sensors Sda and Sdb at positions around the door ducts 312 and 314 for sensing the temperatures around the door ducts 312 and 314. That is, the first and second sensors Sda and Sdb are mounted at positions around the two door ducts 312 and 314, respectively. The amount of cool air for the first and second branch ducts 162 and 164 is controlled in response to the temperatures sensed by the sensors Sda and Sdb. That is, upon sensing the temperatures, the sensors Sda and Sdb output temperature signals to a microprocessor (not shown) of the refrigerator, thus allowing the microprocessor to operate the motor M in response to the temperature signals. The angular position of the regulator 172 is thus adjusted to control the amount of cool air for the first and second branch ducts 162 and 164. In a brief description, the amount of cool air for the two branch ducts 162 and 164 is controlled in accordance with the temperatures sensed by the sensors Sda and Sdb.

The operational effect of the above cool air supplying device will be described hereinbelow.

When at least one of the temperatures sensed by the sensors Sda and Sdb is higher than a reference point, the refrigeration cycle starts to supply cool air for the fresh food compartment 200. In such a case, cool air from the evaporator 104 in the heat exchanging chamber 102 is partially supplied into the freezer compartment 100. The remaining part of the cool air from the evaporator 104 passes downwardly through the passage 120. The cool air from the passage 120, thereafter, passes through the damper device 180 prior to reaching the rear duct 102 of the fresh food compartment 200. The cool air for the fresh food compartment 200 also passes through the connection duct 160.

The cool air from the connection duct 160 is introduced into the two branch ducts 162 and 164 with the amount of cool air for the two ducts 162 and 164 being controlled by the cool air distribution unit 170.

In a detailed description, when the temperatures, sensed by the sensors Sda and Sdb mounted at the upper and lower positions of the door 300, are all higher than a reference point, the regulator 172 of the unit 170 is set to its position P0 by the motor M. Cool air from the connection duct 160 is thus divided into two equal parts prior to being introduced into both branch ducts 162 and 164.

However, when only the temperature, sensed by the upper sensor Sda, is higher than the reference point, the regulator 172 is set to its position P2 by the motor M. Cool air from the connection duct 160 is thus concentrically introduced into the first branch duct 162. In such a case, only the first door duct 312 discharges cool air into the fresh food compartment 200.

On the other hand, when only the temperature, sensed by the lower sensor Sdb, is higher than the reference point, the regulator 172 is set to its position P1 by the motor M. Cool air from the connection duct 160 is thus concentrically introduced into the second branch duct 164. In such a case, only the second door duct 314 discharges cool air into the fresh food compartment 200.

When food is newly stored in either one of the two door baskets 322 and 324, thus increasing the temperature around the basket newly loaded with food, cool air is concentrically supplied into the basket through an associated door duct 312, 314. The cool air supplying device of this invention thus effectively and quickly cools the door basket newly loaded with food.

In the present invention, it is preferable to design the cool air supplying device so that the device starts to supply cool air for the fresh food compartment when at least one of the temperatures sensed by the sensors Sa and Sb, installed on the side and/or rear wall of the fresh food compartment 200, and the sensors Sda and Sdb, mounted to the door 300 at positions around the baskets 322 and 324, is higher than a reference point. Particularly when the temperatures around the baskets 322 and 324 are higher than the reference point due to, for example, food newly stored in the baskets, the device of this invention effectively and concentrically supplies cool air into the baskets 322 and 324.

As described above, the present invention provides a cool air supplying device for a fresh food compartment in refrigerators. In the device of this invention, cool air is discharged from both the rear duct and the door duct into the fresh food compartment forwardly and rearwardly, thus uniformly cooling all areas of said compartment without forming any temperature difference between the areas. Therefore, the device effectively maintains the freshness of food in the fresh food compartment for a lengthy period of time regardless of areas loaded with food.

The device of this invention also effectively and quickly cools areas around the door baskets by concentrically discharging cool air from the door ducts into the areas. Therefore, it is possible to directly supply cool air to food stored in an area around or inside the door baskets.

In addition, when food is newly stored in an area of the door baskets and increases the temperature around the area, the device of this invention concentrically supplies cool air to the area, thus effectively and quickly cooling the newly stored food.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cool air supplying device for a fresh food compartment in refrigerators, comprising:

a cool air passage extending from an evaporator to said fresh food compartment;

a connection duct branched from said passage and extending to a front portion of said compartment with a plurality of air outlet openings of said connection duct being positioned at said front portion of the compartment;

a plurality of door ducts provided on a door of said fresh food compartment and individually having an air inlet opening at a position selectively aligned with an associated one of said air outlet openings of the connection duct when said door is fully closed, said door ducts also individually having a plurality of air outlet ports capable of discharging cool air from each of the door ducts into said fresh food compartment in a direction from the door to a rear wall of said compartment; and a cool air distribution unit controlling the amount of cool air for the outlet openings of the connection duct.

2. The cool air supplying device according to claim 1, wherein the number of air outlet openings of the connection duct and the number of said door ducts are individually two.

3. The cool air supplying device according to claim 2, wherein said cool air distribution unit comprises:

a rotatable regulator provided at a branched junction where said two air outlet openings are branched from said connection duct; and a motor selectively rotating said regulator between a plurality of angular positions, thus allowing the regulator to control the amount of cool air for the two door ducts.

4. The cool air supplying device according to claim 1, wherein said connection duct extends in an insulating material set in both a barrier and a side wall of said fresh food compartment, said barrier isolating the fresh food compartment from a freezer compartment.

5. The cool air supplying device according to claim 1, further comprising:

a plurality of temperature sensors provided on said door at positions around said door ducts, thus sensing temperatures around said door ducts and allowing said cool air distribution unit to control the amount of cool air for the outlet openings of the connection duct in response to temperatures sensed by said sensors.

6. The cool air supplying device according to claim 5, wherein said door ducts are individually arranged along a door basket, said basket being provided on an interior wall of said door for storing food.

7. The cool air supplying device according to claim 5, wherein said door ducts are individually arranged in a door basket, said basket being provided on an interior wall of said door for storing food.

8. The cool air supplying device according to claim 5, wherein said door ducts are individually cast with a door basket into a single structure, said basket being provided on an interior wall of said door for storing food.

9. The cool air supplying device according to claim 6, wherein said air outlet ports of the door ducts discharge cool air into said fresh food compartment while allowing the cool air from them to pass by food stored on said baskets.

* * * * *